US008856985B2

(12) United States Patent
Rensink et al.

(10) Patent No.: US 8,856,985 B2
(45) Date of Patent: Oct. 14, 2014

(54) CONNECTOR SYSTEM FOR MATTRESS

(75) Inventors: Bob Rensink, Denver, CO (US); Jonathan Amendola, Denver, CO (US)

(73) Assignee: Denver Mattress Co. LLC, Denver, CO (US)

( * ) Notice: Subject to any disclaimer, the term of this patent is extended or adjusted under 35 U.S.C. 154(b) by 259 days.

(21) Appl. No.: 13/360,207

(22) Filed: Jan. 27, 2012

(65) Prior Publication Data

US 2013/0192001 A1 Aug. 1, 2013

(51) Int. Cl.
*A47C 21/02* (2006.01)

(52) U.S. Cl.
USPC ..... 5/504.1; 5/503.1; 5/658; 5/482; 5/494; 5/499

(58) Field of Classification Search
USPC ..... 5/482, 494, 498, 499, 658, 504.1
See application file for complete search history.

(56) References Cited

U.S. PATENT DOCUMENTS

| | | | | | |
|---|---|---|---|---|---|
| 805,330 | A | * | 11/1905 | Tompkins | 5/411 |
| 1,842,873 | A | * | 1/1932 | Leeking | 5/411 |
| 1,959,920 | A | | 5/1934 | Kaiser | |
| 1,972,919 | A | | 9/1934 | Chambless | |
| 2,188,576 | A | | 1/1940 | Mulloy | |
| 2,254,423 | A | | 9/1941 | Gerry | |
| 2,661,486 | A | * | 12/1953 | Roher | 5/248 |
| 2,838,770 | A | | 6/1958 | Chezem | |
| 2,896,226 | A | | 7/1959 | Swicegood et al. | |
| 3,394,416 | A | | 7/1968 | Hale | |
| 3,530,516 | A | | 9/1970 | Marquette | |
| 4,336,621 | A | * | 6/1982 | Schwartz et al. | 5/658 |
| 4,625,352 | A | | 12/1986 | Kobayashi | |
| 4,653,131 | A | * | 3/1987 | Diehl | 5/494 |
| 5,072,470 | A | | 12/1991 | Lysiak | |
| 6,009,579 | A | | 1/2000 | Pedersen | |
| 6,233,764 | B1 | * | 5/2001 | Orr | 5/496 |
| 6,687,935 | B2 | * | 2/2004 | Reeder et al. | 5/691 |
| 6,715,173 | B2 | | 4/2004 | Barman et al. | |
| 7,832,033 | B1 | * | 11/2010 | Berkshire | 5/424 |
| 2004/0060113 | A1 | * | 4/2004 | Lantagne | 5/494 |
| 2009/0172881 | A1 | | 7/2009 | Peterson | |
| 2010/0154125 | A1 | | 6/2010 | Fratovich | |
| 2011/0005000 | A1 | * | 1/2011 | Rippe et al. | 5/737 |

* cited by examiner

*Primary Examiner* — William Kelleher
(74) *Attorney, Agent, or Firm* — Kilpatrick Townsend & Stockton LLP

(57) ABSTRACT

A connector system includes at least one mattress connector that is coupled to a mattress. The mattress connectors are coupled at the head end and at the foot end of the mattress. A topper connector is coupled to a topper at a head end and a foot end of the topper. A plurality of straps are employed to couple the mattress to the topper, with the straps being coupled to the mattress connectors and the proper connectors.

19 Claims, 9 Drawing Sheets

CONNECTOR SYSTEM FOR MATTRESS

BACKGROUND OF THE INVENTION

In recent years a variety of sleep systems have been proposed in order to enhance user comfort when sleeping on a mattress. For example, padding layers are often added to a mattress to provide additional cushioning. One popular type of padding is the so-called "pillow top" mattress where padding materials are incorporated into a quilting positioned above the mattress.

Another popular type of cushioning is a "topper" which is a layer of padding that is loosely placed on top of a regular mattress. One problem experienced with toppers is that they can easily slide off the mattress. One traditional way to attach a topper is by user of a mattress cover or mattress pad that envelopes the topper and then surrounds the sides of the mattress. However, these types of mattress covers typically do not work with toppers that are used with adjustable beds that can be inclined or declined.

BRIEF SUMMARY OF THE INVENTION

The invention provides exemplary connector systems, mattress systems, and associated methods for conveniently coupling a topper to a mattress. Although useful with nearly all toppers and mattresses, the invention will find particular use with adjustable beds where the mattress can be inclined, declined, or height adjusted in other ways. With the mattress systems of the invention, the topper is able to remain firmly secured to the mattress while the bed is adjusted.

In one particular embodiment, the invention provides a connector system that comprises at least one mattress connector that is coupled to a mattress. Such a mattress can include a top surface, a bottom surface, and four sides extending between the top surface and the bottom surface. The mattress can also conveniently be defined in terms of a head end and a foot end, although it will be appreciated that the position of a sleeper on a mattress may not depend on whether they are at the head end or the foot end. One of the mattress connectors is coupled at the head end and another is coupled at the foot end. Further, at least one topper connector is coupled to the topper at the head end and at the foot end of the topper. A plurality of straps are used to secure the topper to the mattress, with one of the straps being coupled to the mattress connector at the head end of the mattress and to the topper connector at the head end of the topper. The other strap is coupled to the mattress connector at the foot end of the mattress and the topper connector at the foot end of the topper. However, it will be appreciated that the connectors and straps may be provided at other locations as well, and in some cases, only one set of connectors and its associated strap may be needed.

In one particular arrangement, each strap has two ends, and an interlocking connector is coupled to each end. The interlocking connectors are interlocked to secure the straps to the mattress connectors and the topper connectors after the straps have been inserted through their respective connectors. Although a variety of connectors may be used, one type of mattress connector is a metal ring. A similar connector could also be used for the topper connectors. In one aspect, the interlocking connectors are hourglass shaped so that they may easily be interconnected by inserting one of the connectors through the other connector and then twisting them in opposite directions.

In another aspect, the mattress connectors and topper connectors may comprise metal D-rings. These metal rings may be coupled to the mattress and the topper using fabric segments that are sewn to the mattress and the topper. As one example, the straps may comprise nylon straps that are sewn to the mattress and the topper. Examples of other connectors that may be used include snaps, a hook and loop fastener material, buttons, clips, buckles, ties, hook and eye connectors and the like.

In another embodiment, the invention provides a bed that comprises a mattress having a top surface, a bottom surface, and four sides extending between the top surface and the bottom surface. The mattress also has head end and a foot end. A topper is configured to be positioned over a top surface of the mattress and also has a head end and a foot end. At least one mattress connector is coupled to the mattress at the head end and the foot end of the mattress. At least one topper connector is coupled to the topper at the head end and at the foot end of the topper. Straps are then used to couple the mattress to the topper by coupling the strap to the mattress connector at the head end of the mattress and to the topper connector at the head end of the topper. Another strap is coupled to the mattress connector at the foot end of the mattress and to the topper connector at the foot end of the topper.

The straps may have interlocking connectors that are coupled to each end so that the straps may be placed through the connectors on the mattress and the topper and then interlocked together. For example, the mattress connectors and topper connectors may comprise metal rings, and the interlocking connectors may comprise hourglass shaped rings.

In another aspect, two or more straps could be coupled to the mattress and the topper at both head end at the foot end in a manner similar to that previously described. Also, one or more straps could be similarly connected at the sides of the mattress.

In some cases, the mattress will be coupled to an adjustable frame that includes at least one mechanism to vary the height of at least one portion of the mattress. Hence, the adjustable frame may be used to incline, decline or otherwise orient the mattress to the needs of the user. By using the straps as connectors, the topper is prevented from sliding off from the mattress, even with the weight of the user on top of the topper.

In a further embodiment, the invention provides an exemplary method for coupling a topper to a mattress by using straps that are placed between connectors that are coupled to both the mattress and the topper in a manner similar to that previously described.

DETAILED DESCRIPTION OF THE INVENTION

Figure 1:
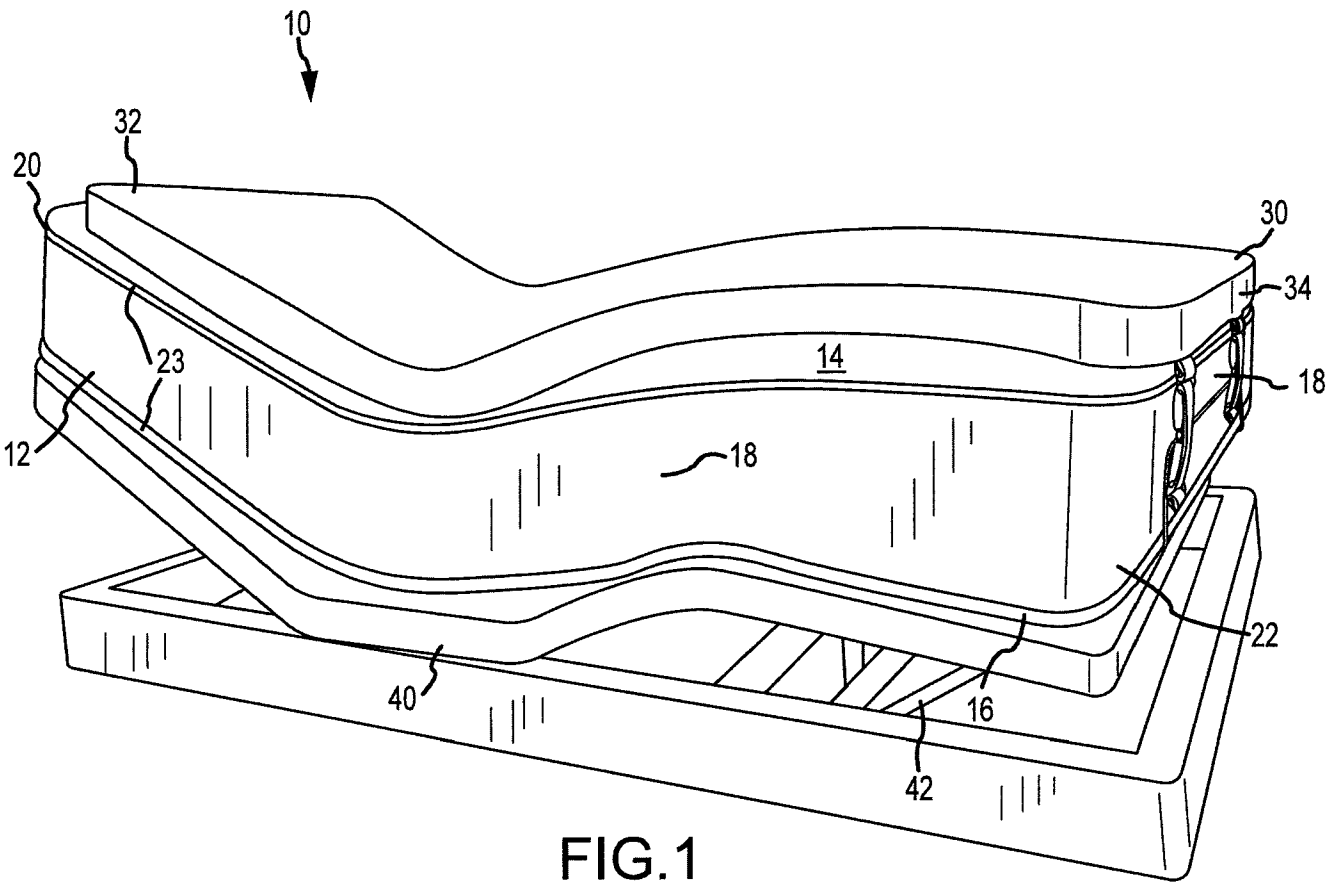
FIG. 1 is a perspective view of a mattress system shown in use with an adjustable bed.
Figure 2:
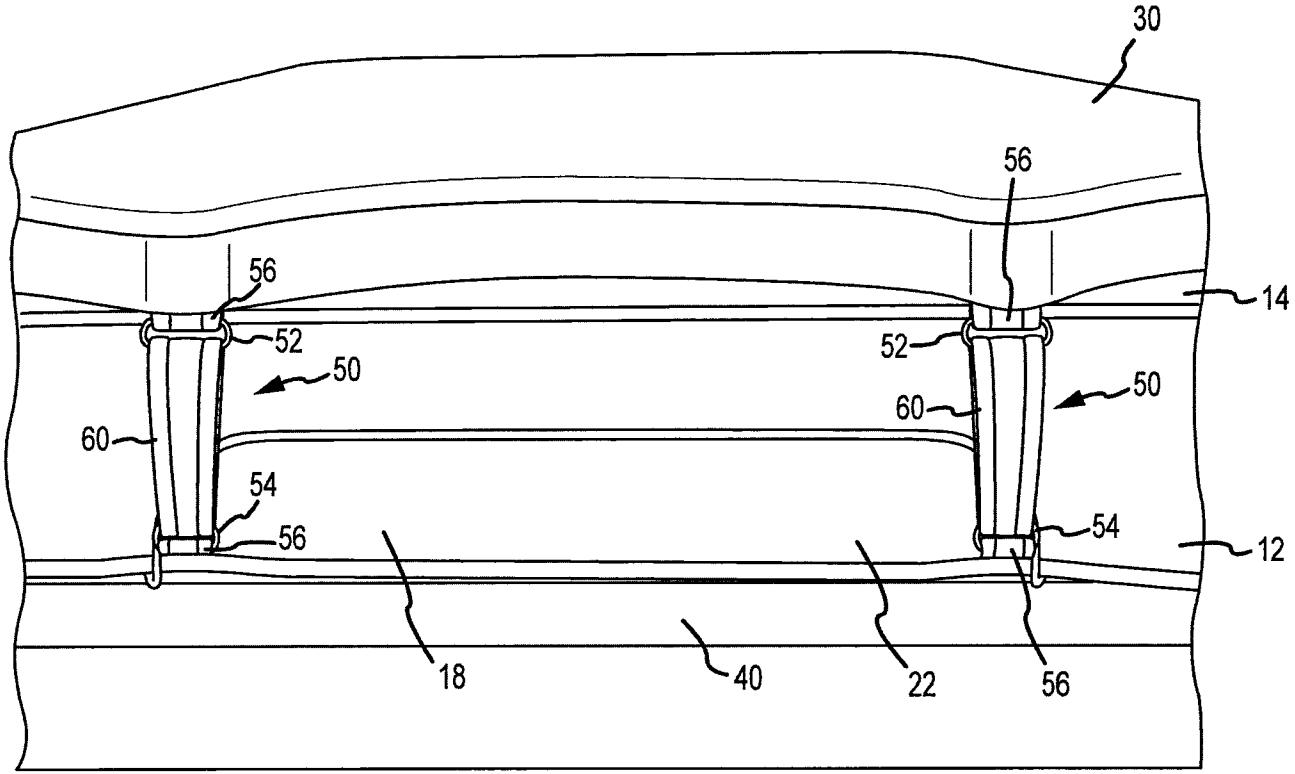
FIG. 2 illustrates the mattress system of FIG. 1 showing the foot of the mattress with an exemplary connector system.
Figure 3:
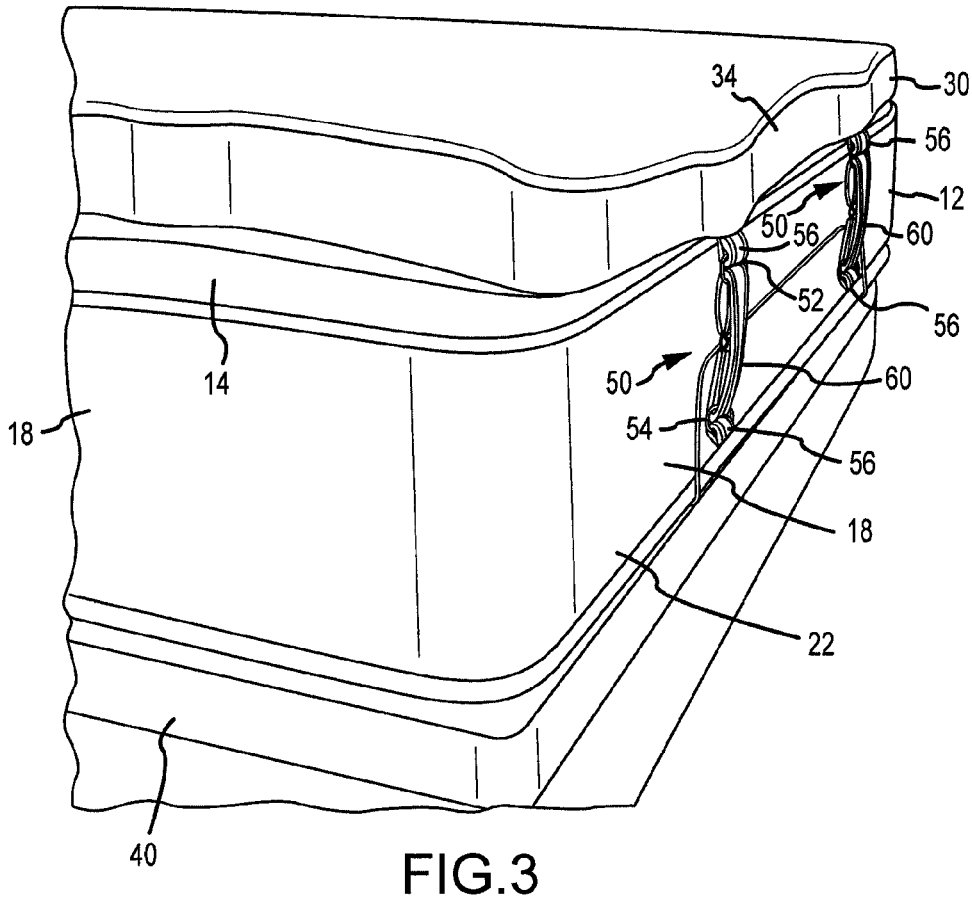
FIG. 3 illustrates the mattress system of FIG. 1 with a more detailed view of the connectors.
Figure 4:
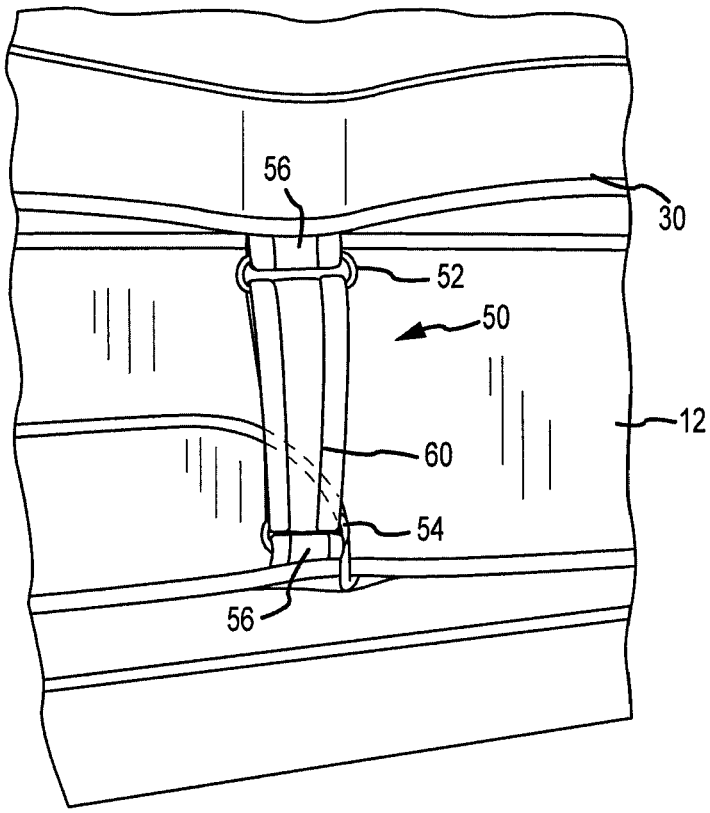
FIG. 4 is a close-up view of one of the connectors.
Figure 5:
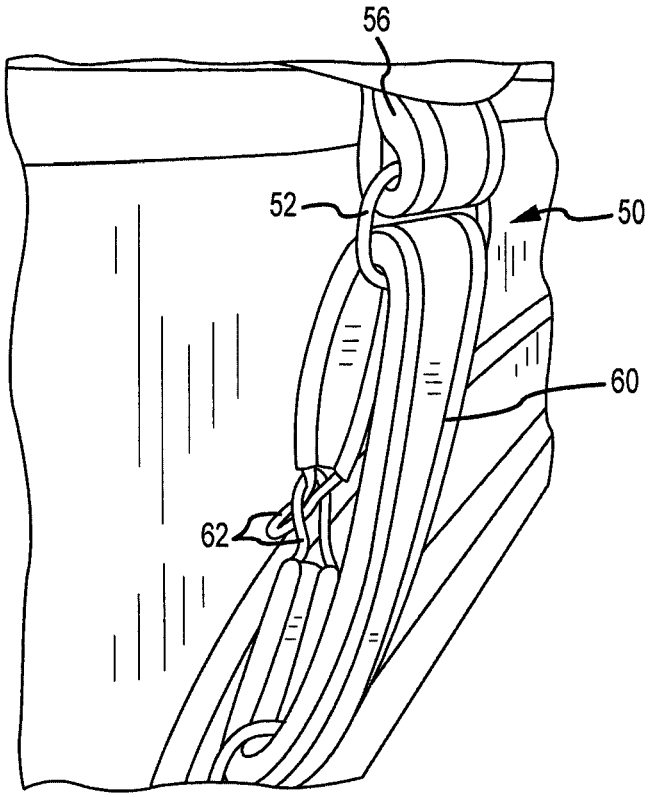
FIG. 5 is still a more detailed view of one of the connectors.

In most current mattresses, the materials that provide comfort to the user, and the materials that provide support to the user, are combined in a single mattress unit. In most cases the support materials (such as springs, high density foams and the like) may last for years, while the comfort materials of a mattress (i.e., the soft plush materials closest to the resting body) wear out at much a faster rate.

One feature of the invention is to address this problem by separating the support materials (also referred to herein as the mattress core) and the comfort materials (also referred to herein as the mattress topper) into two separate and interchangeable entities. While an individual's needs may change through aging, personal preference, or wear of cushioning material, this arrangement avoids replacing the entire unit. Should, for instance, the mattress topper need to be replaced, a user may simply loosen the straps, roll and discard the topper and easily replace it with a new one, all the while keeping their mattress core intact.

One feature of the invention is the ability to use such toppers with a separate mattress that may be adjusted using an adjustable bed foundation. Because the foundation can raise and lower at an angle, traditional toppers will tend to simply "flop over". To address this issue, the invention provides various connector straps that secure the topper and mattress together and mitigate against any slippage or movement of the topper. These connectors may also be used with toppers placed on stationary foundations or platform beds where the topper could shift through normal use.

Hence, the invention provides a variety of connector systems that may be used to couple a topper to a mattress. The connector systems are configured so that they are easy to install, yet secure enough that they will hold the topper to the mattress, even when surface of the mattress is elevated and/or when excessive weight is placed onto the topper. For example, the connector systems will find particular use with adjustable mattresses that utilize one or more mechanisms to elevate the head or foot of the bed. In so doing, the connector systems securely hold the topper to the mattress so that it will not slide off of the mattress. In the event that the topper needs to be changed, the connector systems may easily be removed to allow for removal of the topper.

The invention may be used with a wide variety of mattresses. Such mattresses typically include a core that is covered with a fabric. Examples of cores that may be used include spring cores, latex cores, air bladders, individually wrapped coil springs, and the like. Typically, separate pieces of fabric will be used on the top, bottom, and sides, with seams running between the sides and the top and bottom, respectively. In some cases, a piping may included at the outer periphery of the top and bottom of the mattress where the seam extends. In one particularly advantageous embodiment, the fabric segment (such as fabric segment 56 described hereinafter) is sewn into the edge where the border of the mattress core or topper comes into contact with the top or bottom panel of the mattress core or topper. This edge may be further reinforced with a tape edger and Kevlar thread or any other durable thread.

The invention may also utilize a wide variety of toppers that are positioned on top of the mattress. Toppers are generally defined as any type of padding material that loosely rests on top of the mattress. In some cases, the padding material is encased in a fabric. As one example, the topper may include a generally rectangular piece of foam material having the general shape of the mattress, yet is significantly thinner in thickness. Merely by way of example, toppers may have thicknesses in the range from about one inch to about twelve inches. Typically, the fabric used to encase the padding material includes seams that run along the outer periphery, and may also include a piping material similar to conventional mattresses. Examples of filling materials that may be used in cores include foams, such as polyurethane foam, visco elastic foams, air bladders, air spacer materials, gels and the like.

Shown in FIG. 1, is one embodiment of a mattress system 10 that comprises a mattress 12 having a top surface 14, a bottom surface 16 and sides 18 that extend between the top surface 14 and bottom surface 16. For convenience of discussion, the mattress may be defined in terms of a head end 20 and a foot end 22. Mattress 12 may be constructed of a core that is encased in fabric. This fabric may be in multiple pieces that are sewn together along seam lines. In some cases, piping 23 may be placed along the seam lines.

Disposed on top surface 14 is a topper 30 that may also be defined in terms of a head end 32 and a foot end 34. Topper 30 may comprise a padding material that is encased in fabric similar to mattress 12. Topper 30 may have various seam lines where the fabric is sewn together to encase the padding material.

Optionally, the mattress 12 and topper 30 may be used with an adjustable frame 40 that includes various mechanisms 42 to raise and lower various portions of the mattress 12. For example, as shown in FIG. 1 the head end 20 is inclined as well as the foot end 22. However, it will be appreciated that the mattress may be inclined in a variety of different ways.

Referring also now to FIGS. 2-5, exemplary connector systems 50 that are used to couple the topper 30 to mattress 12 will be described. The connector systems 50 may be placed at different locations on mattress system 10. As shown, there are two connector systems 50 at the foot end 22 and two connector systems 50 at the head end 20. However, it will be appreciated that other numbers could be provided either at the head end or the foot end. Further, although not shown, one or more connector systems 50 could also be placed at the sides 18 of the mattress to couple the topper 30 to the mattress 12 along the sides.

Figure 6:
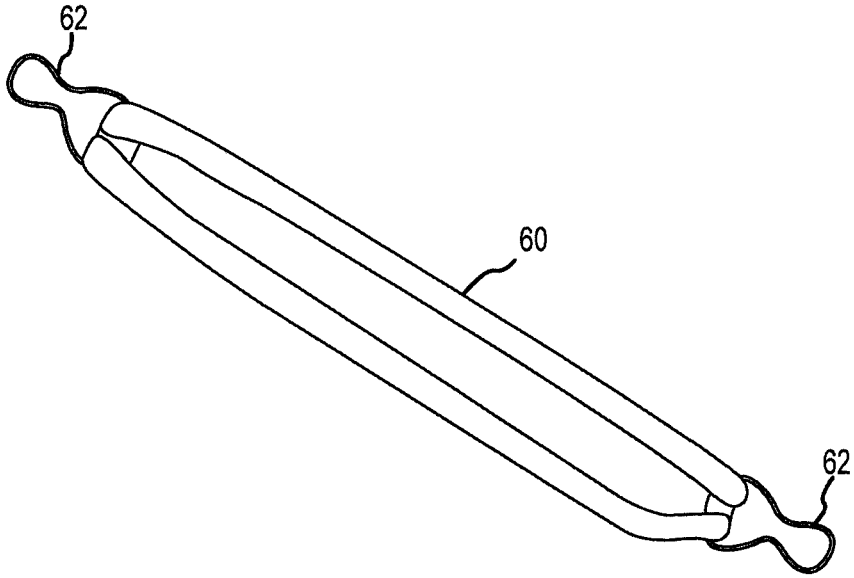
FIG. 6 illustrates one of the straps that has been removed from the mattress system of FIG. 1.
Figure 7:
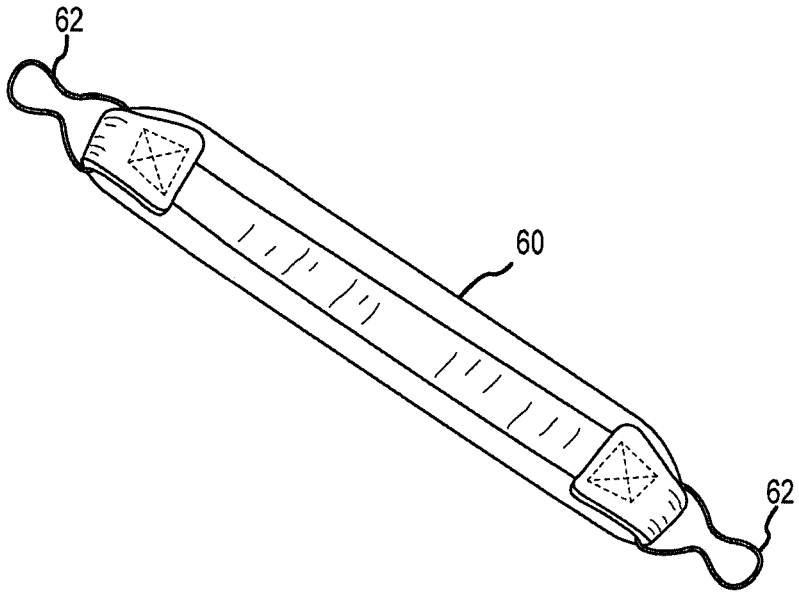
FIG. 7 illustrates a rear view of the strap of FIG. 6.

Each connector system 50 comprises a topper connector 52 and a mattress connector 54 that are coupled to the topper 30 and mattress 12, respectively. The connectors 52 and 54 comprise ring connectors that are sewn to the topper 30 and mattress 12 using fabric segments 56. Fabric segments 56 may be sewn into the seam lines of mattress 12 so that they will not tear away from mattress 12 even when significant force is applied. The opposing fabric segments 56 may similarly be sewn into the seam lines of topper 30. In this way, connectors 52 and 54 are sewn directly to the mattress 12 and topper 30 (typically into a seam) so that they will not tear or break during use. Placed between connectors 52 and 54 is a strap 60 that is used to couple the topper 30 to the mattress 12. Connector 60 is shown in greater detail in FIGS. 6 and 7. Straps 60 may be constructed of a durable fabric, such as a nylon webbing, quilted materials, other non-stretchable fabrics, leather, vinyl, or the like. Further, at each end of strap 60 is an interlocking connector 62. As shown, interlocking connectors 62 are hourglass in shape and are sewn to each end of strap 60. In this way, connectors 62 may pass through connectors 52 and 54 and then interlock with each other to secure the topper to the mattress. Other types of interlocking connectors could be used, such as snaps, a hook and loop fastener material, buttons, clips, buckles, ties, hook and eye connectors and the like.

Figure 8:
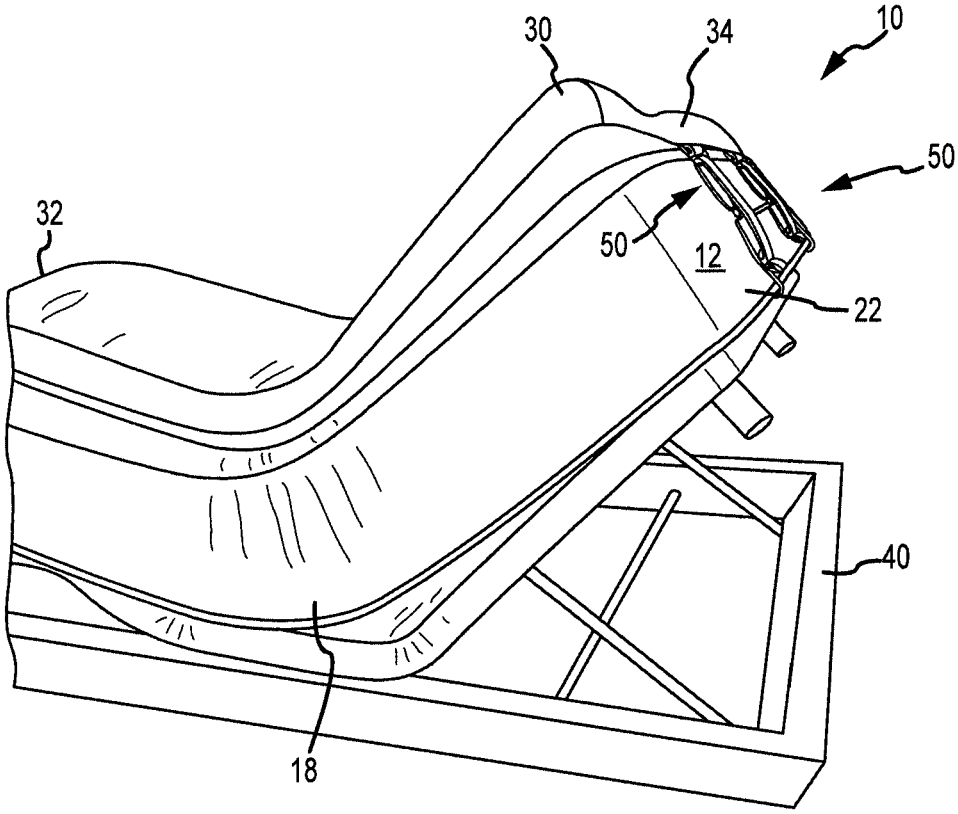
FIG. 8 illustrates a head end of the mattress system of FIG. 1 when elevated, with the connectors holding the topper to the mattress.
Figure 9:
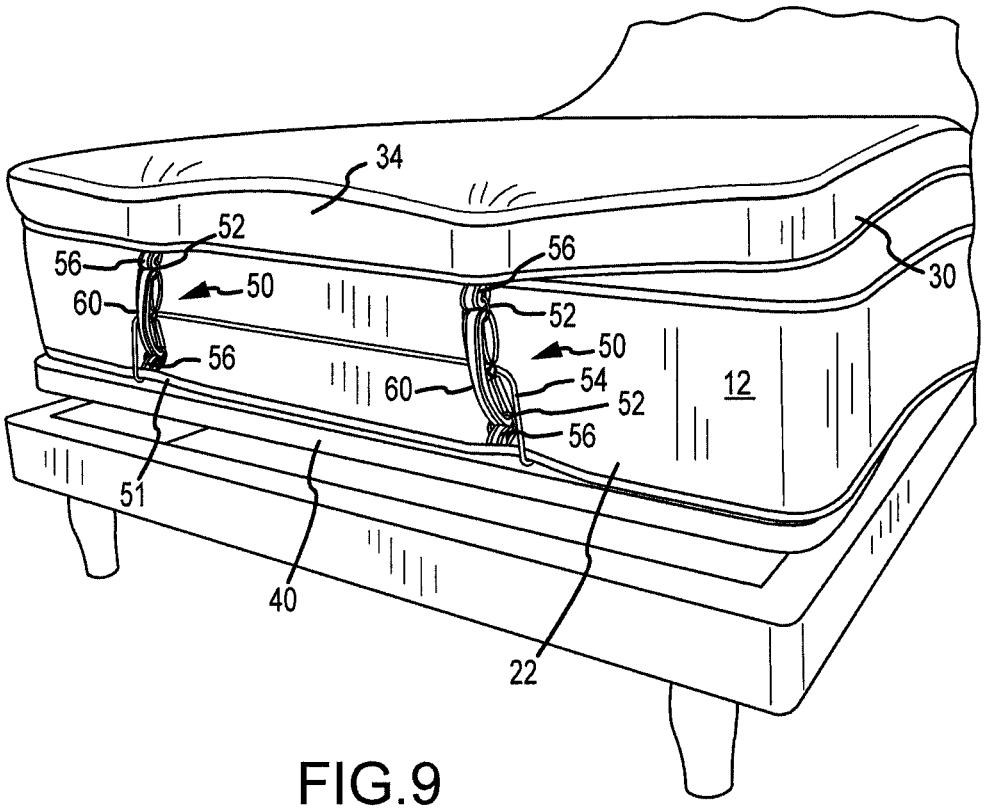
FIG. 9 is a view of the foot end of the mattress system of FIG. 1, with the connectors shown holding the topper to the mattress when the foot is elevated.

Once securely connected, the topper 30 will remain secured to mattress 12 even when the bed is adjusted as illustrated in FIGS. 8 and 9. As shown, the head and foot ends 20 and 22 may be elevated. In so doing, gravity and the weight of the user will tend to pull topper 30 from off of mattress 12. However, connector systems 50 hold the topper 30 securely to mattress 12 so that it does not slip off. Further, by constructing connector systems 50 of durable straps and using metal rings as connectors that are sewn to the topper and the mattress, the connection points will not tear and the connectors will not break.

Although shown with ring connectors 52 and 54 that are sewn to mattress 12 and topper 30 by fabric segments, it will be appreciated that other types of connectors could be used to which straps may be coupled. For example, instead of using a ring connector, other types of possible connectors include other shaped rings, such as D-rings, O-rings, the like. Also, cam and spring buckle connectors could be used to couple a strap to the mattress and topper. Other kinds of connectors include slides, loops, strap adjustors, snap hooks, side release buckles, hooks, carabiners, spring links, and the like. Materials that may be used to construct such connectors include metal, plastic, nylon and the like. In some cases, other types of fasteners could be used to couple straps between the topper and the mattress, including hook and loop fastener materials, buttons, ties, snaps, clips, and the like. As one specific example, pieces of hook and loop fabric material may be sewn to the sides of the topper and the mattress. Corresponding pieces of hook and loop fastener material could also be coupled to the straps which could then be directly coupled to the mattress and topper by interlinking the opposing pieces of hook and loop fastener materials. Similar processes could be used with buttons, ties, clips, and the like. One advantage to using each of these types of connector systems is that they can quickly and easily be used to couple the straps to the topper and the mattress. This permits the topper to be removed in an easy manner whenever needed. Further, these types of systems are strong and durable so that they will not break when excessive force is applied to the straps, such as the topper attempts to move relative to the mattress.

In another embodiment, fabric segments 56 could be made longer and provided with interlocking connectors at their ends. In this way, the fabric segment attached to the topper could be directly coupled to the fabric segment that is attached to the mattress using any of the connectors described herein. In some cases, the two fabric segments could simply be tied to each other. This embodiment would eliminate the need for strap 60. Further, strap length adjusters could be provided on one or both of the fabric segments to alter their length, if needed.

In a further option, fabric segments 56 could be formed as fabric loops that are coupled to the mattress and the topper. A connector, such as a strap, could then be coupled to each of the fabric loops. As another option, the fabric segments 56 could terminate in fabric loops that would serve as connectors so that a strap could be coupled to each of the fabric loops.

The invention has now been described in detail for purposes of clarity and understanding. However, it will be appreciated that certain changes and modifications may be practiced within the scope of the appended claims.

What is claimed is:

1. A connector system comprising:

at least one mattress connector coupled to a mattress that comprises a top surface, a bottom surface, and four sides extending between the top surface and the bottom surface, a head end, and a foot end, wherein a first seam couples the four sides with the top surface and a second seam couples the four sides with the bottom surface, wherein the mattress connector is coupled to the mattress at the first seam or the second seam so as to extend along at least one of the sides of the mattress;

at least one topper connector coupled to a topper, the topper comprising a top, a bottom, and four topper sides extending between the top and the bottom, wherein a third seam couples the four topper sides with the top and a fourth seam couples the four topper sides with the bottom, wherein the topper connector is coupled to the topper at the fourth seam; and at least one strap that is coupled to the mattress connector and to the topper connector.

2. A connector system as in claim 1, wherein mattress connectors are coupled to the mattress at the head end and at the foot end of the mattress, wherein topper connectors are coupled to the topper at a head end and at a foot end of the topper; and wherein one strap is coupled to the mattress connector at the head end of the mattress and to the topper connector at the head end of the topper, and with another one of the straps being coupled to the mattress connector at the foot end of the mattress and to the topper connector at the foot end of the topper.

3. A connector system as in claim 2, wherein each of the straps has two ends, wherein an interlocking connector is coupled to each end, and wherein the interlocking connectors are interlocked to secure the straps to the mattress connectors and the topper connectors.

4. A connector system as in claim 3, wherein the interlocking connectors are hourglass shaped.

5. A connector system as in claim 1, wherein the mattress connectors are selected from a group consisting of metal rings, snaps, a hook and loop fastener material, buttons, clips, buckles, ties, hook and eye connectors, and wherein the topper connectors are selected from a group consisting of metal rings, snaps, a hook and loop fastener material, buttons, clips, buckles, ties, hook and eye connectors.

6. A connector system as in claim 5, wherein the metal rings are coupled to the mattress and the topper using fabric segments sewn to the mattress and to the topper.

7. A connector system as in claim 2, wherein the straps are selected from a group consisting of nylon, quilted materials, non-stretchable fabrics, leather, and vinyl.

8. A bed comprising:

a mattress having a top surface, a bottom surface, and four sides extending between the top surface and the bottom surface, wherein the mattress has a head end, and a foot end, wherein a first seam couples the four sides with the top surface and a second seam couples the four sides with the bottom surface;

a topper configured to be positioned over the top surface of the mattress, the topper comprising a top, a bottom, and four topper sides extending between the top and the bottom, the topper also having a head end and a foot end, wherein a third seam couples the four topper sides with the top and a fourth seam couples the four topper sides with the bottom;

at least one mattress connector coupled to the mattress at the first seam or the second seam at the head end and at the foot end of the mattress;

at least one topper connector coupled to the topper at the fourth seam at the head end and the foot end of the topper; and a plurality of straps, with one of the straps being coupled to the mattress connector at the head end of the mattress and to the topper connector at the head end of the topper, and with another one of the straps being coupled to the mattress connector at the foot end of the mattress and to the topper connector at the foot end of the topper.

9. A bed as in claim 8, wherein each of the straps has two ends, wherein an interlocking connector is coupled to each end, and wherein the interlocking connectors are interlocked to secure the straps to the mattress connectors and the topper connectors.

10. A bed as in claim 9, wherein the interlocking connectors are selected from a group consisting of hourglass shaped connectors, rings, snaps, a hook and loop fastener material, buttons, clips, buckles, ties, hook and eye connectors.

11. A bed as in claim 9, wherein the mattress connectors are selected from a group consisting of metal rings, snaps, a hook and loop fastener material, buttons, clips, buckles, ties, hook and eye connectors, and wherein the topper connectors are selected from a group consisting of metal rings, snaps, a hook and loop fastener material, buttons, clips, buckles, ties, hook and eye connectors.

12. A bed as in claim 11, wherein the metal rings are coupled to the mattress and the topper using fabric segments sewn to the mattress and to the topper.

13. A bed as in claim 8, wherein a pair of mattress connectors are coupled to the head end, wherein a pair of mattress connectors are coupled to the foot end, wherein a pair of topper connectors are coupled to the head and, wherein a pair of topper connectors are coupled to the foot end, and wherein a pair of straps are coupled to the connectors at the head end of the mattress and wherein a pair of straps are coupled to the connectors at the foot end of the mattress.

14. A bed as in claim 8, further comprising an adjustable frame coupled to the mattress, wherein the adjustable frame includes at least one mechanism to vary the height of at least a portion of the mattress.

15. A method for coupling a topper to a mattress, the method comprising:

providing a mattress having a top surface, a bottom surface, and four sides extending between the top surface and the bottom surface, wherein the mattress has a head end, and a foot end, wherein a first seam couples the four sides with the top surface and a second seam couples the four sides with the bottom surface;

providing a topper comprising a top, a bottom, and four topper sides extending between the top and the bottom, the topper also having a head end and a foot end, wherein a third seam couples the four topper sides with the top and a fourth seam couples the four topper sides with the bottom;

providing at least one mattress connector that is coupled to the mattress at the first seam or the second seam;

providing at least one topper connector coupled to the topper at the fourth seam; and coupling a strap to the mattress connector and to the topper connector.

16. A method as in claim 15, wherein mattress connectors are provided at the head end at the foot end of the mattress, wherein topper connectors are provided at the head end and the foot end of the topper, and further comprising coupling a strap to the mattress connector at the head end of the mattress and to the topper connector at the head end of the topper, and coupling another strap to the mattress connector at the foot end of the mattress and to the topper connector at the foot end of the topper.

17. The connector system as in claim 1, wherein the mattress connector is coupled with the mattress via a fabric segment sewn into the first seam or second seam.

18. The connector system as in claim 1, wherein the topper connector is coupled to the topper via a fabric segment sewn into the fourth seam.

19. The connector system as in claim 1, wherein the top surface of the mattress is in direct contact with the bottom of the topper.

* * * * *